US006296225B1

(12) United States Patent
Watts

(10) Patent No.: US 6,296,225 B1
(45) Date of Patent: Oct. 2, 2001

(54) RAM BORE PROFILE FOR VARIABLE BORE PACKER RAM IN A RAM TYPE BLOWOUT PREVENTER

(75) Inventor: Gerald D. Watts, Hempstead, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/606,264

(22) Filed: Jun. 29, 2000

(51) Int. Cl.[7] ..... E03B 33/06
(52) U.S. Cl. ..... 251/1.3; 251/212; 277/325
(58) Field of Search ..... 251/1.1, 1.2, 1.3, 251/212; 277/325, 324, 327

(56) References Cited

U.S. PATENT DOCUMENTS

| | | | | |
|---|---|---|---|---|
| 3,880,436 | * | 4/1975 | Canal | 277/325 |
| 4,089,532 | | 5/1978 | Kamyshniko et al. | 277/129 |
| 4,229,012 | * | 10/1980 | Williams, III | 277/325 |
| 4,332,367 | * | 6/1982 | Nelson | 251/1.3 |
| 4,444,404 | * | 4/1984 | Parks, Jr. | 277/325 |
| 4,458,876 | * | 7/1984 | Schaeper et al. | 251/1.2 |
| 4,770,387 | * | 9/1988 | Granger | 251/1.3 |
| 5,005,802 | * | 4/1991 | McWhorter et al. | 251/1.3 |
| 5,009,289 | * | 4/1991 | Nance | 251/1.3 X |
| 5,013,005 | | 5/1991 | Nance | 251/1.3 |
| 5,603,481 | * | 2/1997 | Parker et al. | 251/1.3 |
| 5,833,208 | * | 11/1998 | Lee, Jr. | 251/1.3 |

* cited by examiner

*Primary Examiner*—Kevin Shaver
*Assistant Examiner*—Eric Keasel
(74) *Attorney, Agent, or Firm*—Jackie Lee Duke

(57) ABSTRACT

An improved ram bore profile for use with a variable bore ram packer designed for use in a standard ram-type blowout preventer used in oil and gas drilling operations is disclosed. The improved ram bore profile in the ram body is a substantially U shaped cutout in the front face of the ram body. The U shaped ram bore profile extends between the upper surface and lower surface of the ram body. The substantially U shape of the improved ram bore profile is further characterized by having an arcuate rear portion with a pair of diverging sides that extend outwardly toward the front face of the ram body to a front throat that intersects perpendicularly the front face of the ram body. The improved ram bore profile is capable of being used with variable bore packers of different configurations.

10 Claims, 13 Drawing Sheets

RAM BORE PROFILE FOR VARIABLE BORE PACKER RAM IN A RAM TYPE BLOWOUT PREVENTER

BACKGROUND OF THE INVENTION

1. Field of the Invention

This invention relates to an improved ram bore profile for a variable bore packer ram used in a ram-type blowout preventer used for oil and gas drilling operations. The improved ram bore profile allows drill pipe within a given range of sizes to be supported or "hung off" with increased load capacity in comparison to existing designs. Additionally, the current invention ensures the drill pipe weight is in fact supported on the ram body and not on the variable bore packer as in prior art designs. This ensures the variable bore packer is not subjected to unbalanced loads and thereby improves the service life of the packer. Ram-type blowout preventers are part of a pressure control system used in oil and gas drilling operations to control unexpected well bore pressure spikes or "kicks" as they are commonly referred to in the industry.

The blowout preventer has a body with a vertical bore and a pair of laterally disposed opposing bonnet assemblies. Each bonnet assembly includes a piston which is laterally moveable within the bonnet assembly by pressurized hydraulic fluid. Replaceable sealing elements called "packers" are mounted on the ends of the pistons which extend into the blowout preventer bore. When these pistons are moved to a closed position, commonly referred to as "closing the blowout preventer" or "closing the rams", the vertical bore of the blowout preventer is sealed and the "kick" is contained. These "packers" are available in a variety of configurations designed to seal the blowout preventer bore when the opposing pistons are moved to their closed position.

One type of packer has ends designed to seal around pipe of a specific size in the blowout preventer bore when the blowout preventer is "closed." Other packers are configured to seal around a range of pipe sizes. It is the type designed to seal around a range of pipe sizes, called variable bore ram packers, and the ram body in which they are mounted to which the present invention is directed. The ram packers form a pressure tight seal during a kick until the well bore pressure can be controlled. The well bore pressure can reach several thousand pounds per square inch during a "kick." Each ram packer has a semicircular opening in its front face to form a seal around 180° of the outer periphery of the pipe. When the rams are closed as described above, the opposing ram packers meet and seal the entire 360° periphery of the pipe.

During drilling operations, it is sometimes necessary to support the weight of the joints of drill pipe or "drill string" as it is commonly known on the rams of the blowout preventer. This is done by dosing the rams around the straight diameter of the drill pipe and the allowing the drill string to slide downward until an enlarged diameter end, called a tool joint, contacts the top of the ram. Each section or joint of drill pipe has a tool joint formed at each end and the tool joints at opposite ends of a given drill pipe section are threaded with mating male and female threads, respectively. The transition between the straight diameter of the drill pipe and the larger diameter of the tool joint is a tapered shoulder, often referred to as an elevator shoulder. This tapered elevator shoulder contacts the top of the ram and the weight of the drill string is supported by this contact.

Prior art variable bore ram designs typically used a semi-circular cutout in the face of ram body. This semicircular cutout had to be sized to accommodate the largest diameter drill pipe that the variable bore ram packer was designed to seal around. This often resulted in little or no contact between the ram body and the tool joint when a smaller diameter drill pipe and its tool joint were used. In this case, when the rams were closed and the drill string lowered into contact with the ram, it was the portion of the variable bore ram packer protruding beyond the face of the ram that supported the weight of the drill string. The variable bore ram packers were not designed or intended for this type of service. As a result, sometimes the drill string was dropped when the variable bore ram packer could not longer support the weight of the drill string. At the very least, the service life of the variable bore packer was greatly compromised when the packer supported the weight of the drill string. The improved ram bore profile for a variable bore packer ram of the current invention offers a substantial improvement by offering a variable bore packer ram body that can support the weight of the drill string for a range of drill pipe sizes.

2. Description of Related Art

U.S. Pat. No. 4,089,532 to A. I. Kamyshnikov shows a blowout preventer ram assembly with a variable bore ram packer.

The blowout preventer shown in U.S. Pat. No. 5,013,005 to J. G. Nance shows a packer capable of sealing around two strings of tubing disposed in the blowout preventer bore.

SUMMARY OF THE INVENTION

The improved ram bore profile for a variable bore packer ram of the present invention is designed for use in a standard ram-type blowout preventer used in oil and gas drilling operations. The blowout preventer has a body with an axial bore, a pair of opposing bonnet assemblies and a pair of opposing rams laterally moveable within the bonnet assemblies by a pressurized fluid source to control flow of well fluids through the blowout preventer body axial bore. The variable bore ram packer includes a ram body, a top seal, a pair of side packers and a packer member. The packer member is molded of an elastomeric material having a central semi-circular opening sized to fit closely about a tubular member within a given size range.

The improved ram bore profile in the ram body is a substantially U shaped cutout in the front face of the ram body. The U shaped ram bore profile extends between the upper ram body and the ram packer cavity of the ram body. The substantially U shape of the improved ram bore profile is further characterized by having an arcuate rear portion with a pair of diverging sides that extend outwardly toward the front face of the ram body to a front throat that intersects perpendicularly the front face of the ram body. The improved ram bore profile is capable of being used with variable bore packers of different configurations as will be shown in the description of the preferred embodiments.

A principal object of the present invention is to provide an improved ram bore profile for a variable bore ram packer body that allows supporting a range of drill pipe sizes for which the variable bore packer is sized to seal around.

Another object of the present invention is to provide an improved ram bore profile for a variable bore ram packer body that ensures the drill pipe is supported on the ram bore profile and not on the variable bore packer.

A final object of the present invention is to provide an improved ram bore profile for a variable bore ram packer body that increases the service life of the variable bore packer.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENTS

Figure 1:
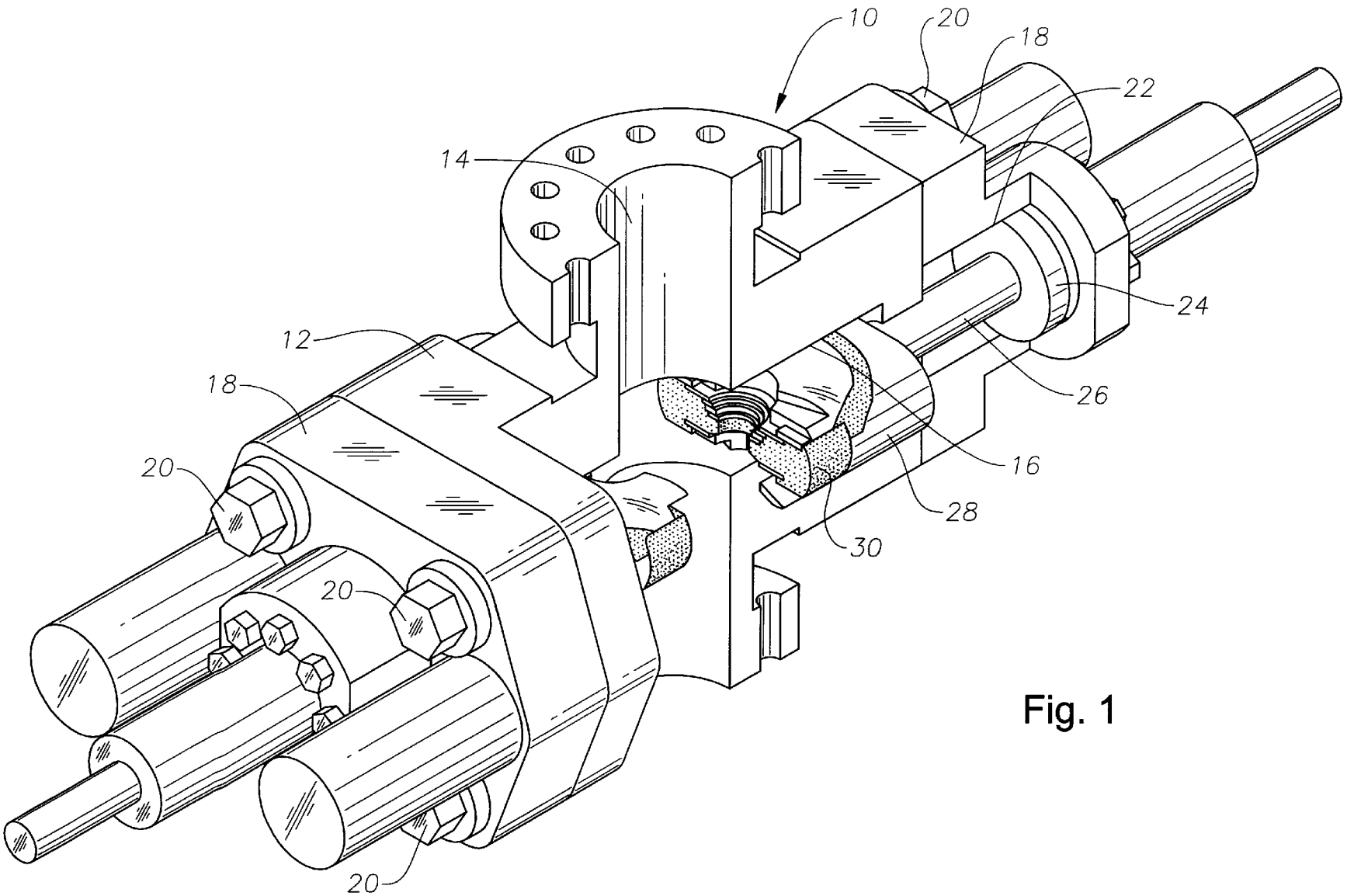
FIG. 1 is a perspective view with a cutaway section of a variable bore ram packer with the improved ram bore profile of the present invention installed in a typical ram-type blowout preventer used in oil and gas drilling operations.

With reference to the drawings, and particularly to FIG. 1, an isometric view with a cutaway section of a ram type blowout preventer 10 used in oil and gas drilling operations is shown. The ram type blowout preventer 10 includes a body or housing 12 with a vertical bore 14 and laterally disposed ram guideways 16. Bonnet assemblies 18 are mounted to the body 12 with suitable securing means such as studs or bolts 20 and aligned with laterally disposed guideways 16. Each bonnet assembly 18 includes an actuation means 22, including a piston 24 and connecting rod 26. While only one guideway 16 and actuation means 22 is shown, it is understood by those of ordinary skill in the art that there is a pair of opposed guideways 16 and actuation means 22. Each connecting rod 26 is connected to a ram 28 with variable bore ram packer assembly 30 positioned therein. Actuation means 22 allows ram 28 and variable bore ram packer assembly 30 to be reciprocated within guideways 16 or "opening and closing the rams" as it is referred to in the industry.

Figure 2:
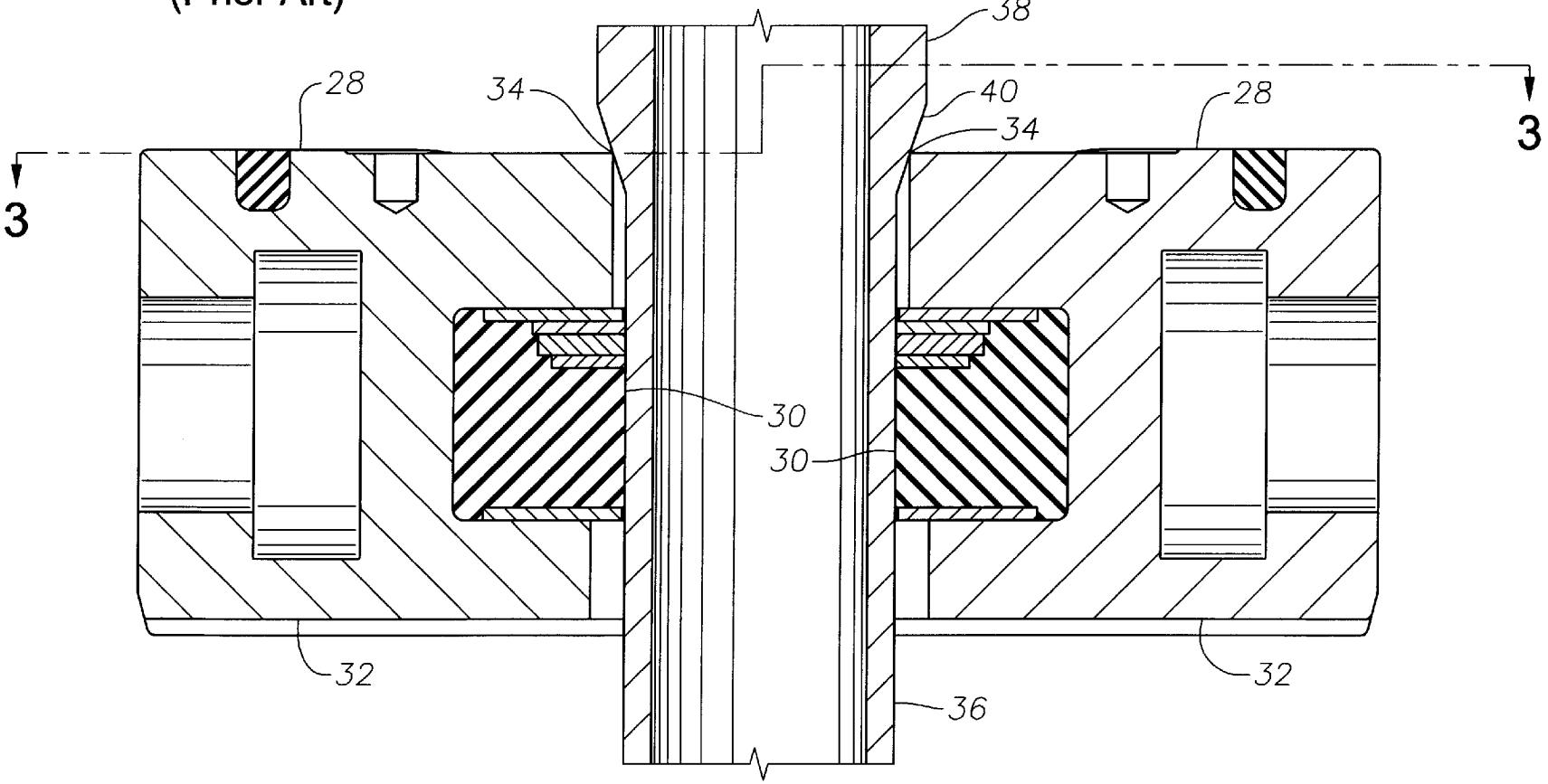
Fig. 2 (Prior Art)
FIG. 2 is an elevation view in section of a pair of variable bore ram packers suspending 6⅝" drill pipe utilizing the ram bore profile of the prior art.
Figure 3:
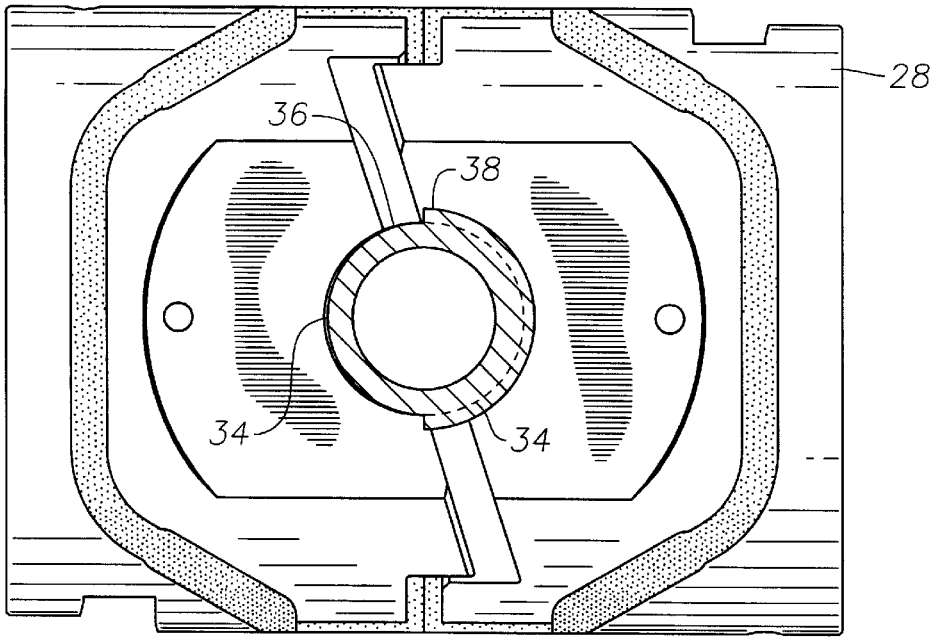
Fig. 3 (Prior Art)
FIG. 3 is a plan view taken along lines 3—3 of FIG. 2.

FIGS. 2 and 3 show a pair of rams 28 with one type of variable bore ram packer 30 positioned within ram bodies 32. Variable bore ram packer 30 is of the type shown and claimed in U.S. Pat. No. 5,005,802 issued Apr. 9, 1991 and is incorporated herein by reference. Ram bodies 32 include prior art ram bore profile 34 with a substantially half circle cross section. Positioned within rams 28 is 6⅝" O. D. drill pipe 36 with tool joint 38 attached at its upper end by suitable means as cold forging or welding. Tool joint 38 will typically have an 8" O. D., as is well known in the art. Elevator shoulder 40 of tool joint 38 allows prior art ram bore profile 34 to support the weight of tool joint 36. As seen in FIG. 3, prior art ram bore profile 34 is sized to fit around the 6⅝" outside diameter of tool joint 36 while prior art ram bore profile 34 engages elevator shoulder 40.

Figure 4:
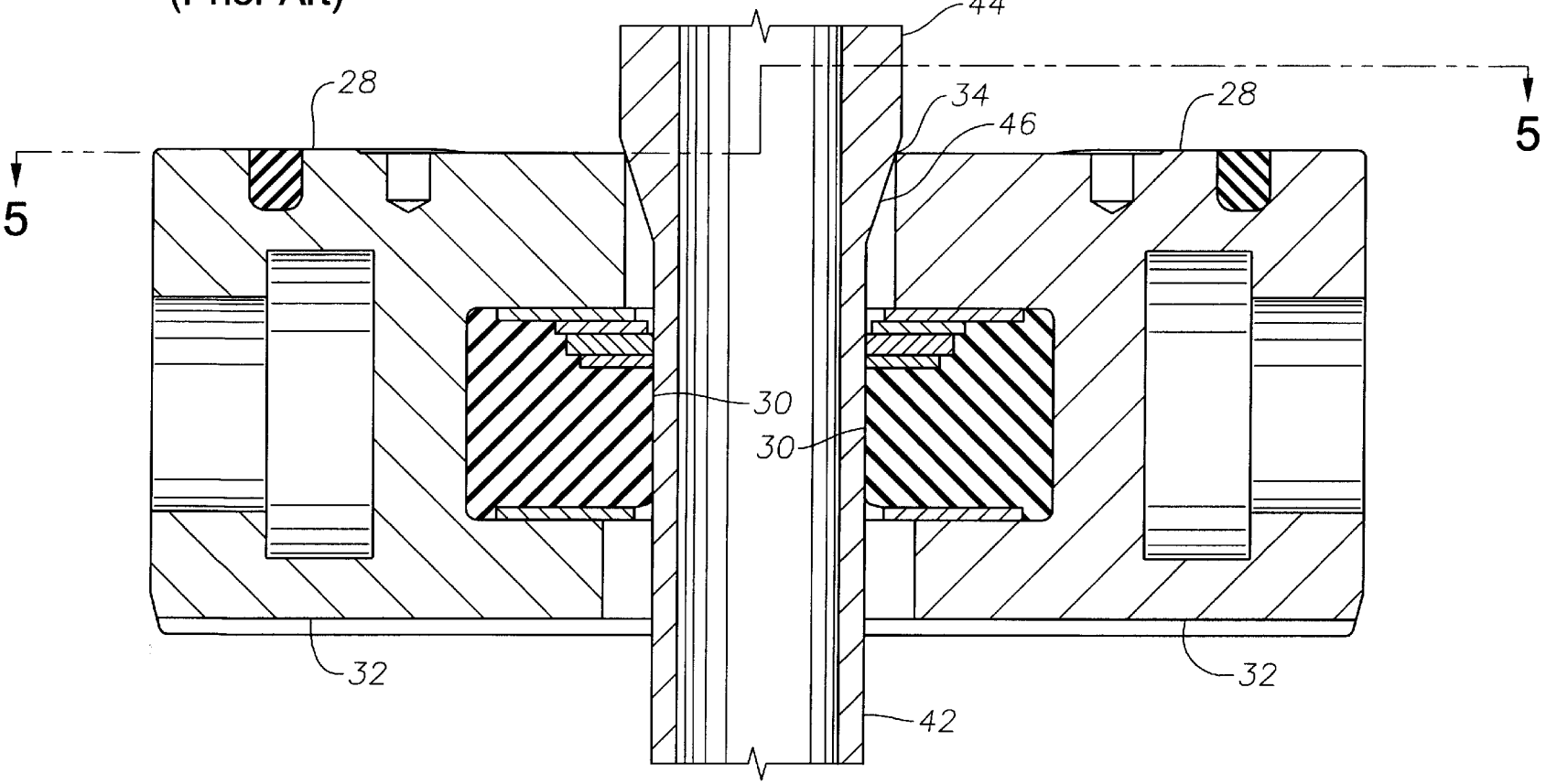
Fig. 4 (Prior Art)
FIG. 4 is an elevation view in section of a pair of variable bore ram packers suspending 5" drill pipe utilizing the ram bore profile of the prior art.
Figure 5:
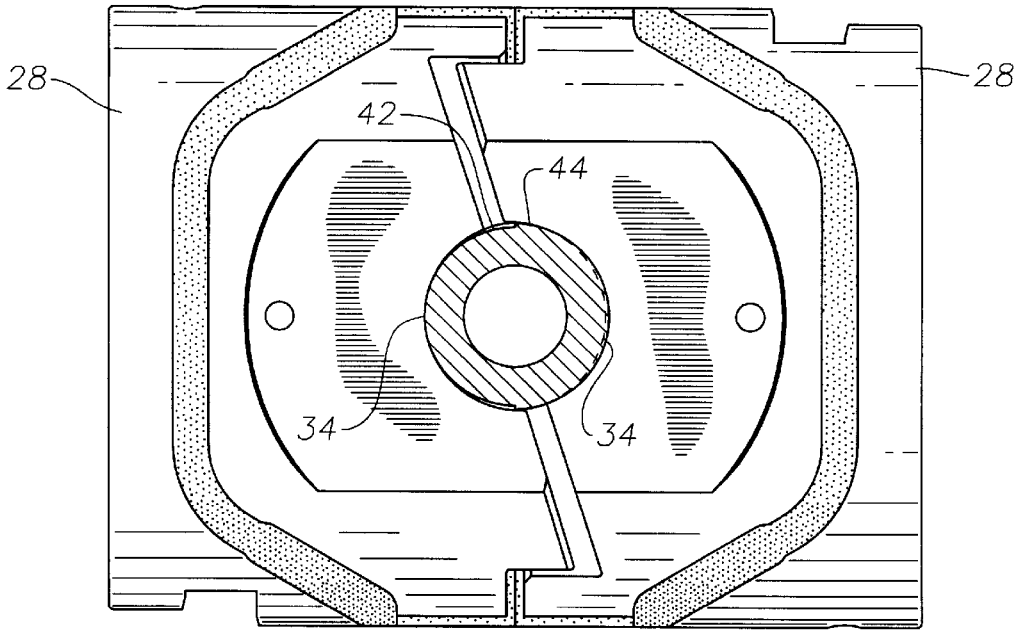
Fig. 5 (Prior Art)
FIG. 5 is a plan view taken along lines 5—5 of FIG. 4.

FIGS. 4 and 5 show the pair of rams 28 with variable bore ram packer 30 positioned within ram bodies 32 with prior art ram bore profile 34 and 5" O. D. drill pipe 42 positioned within rams 28. 5" O. D. drill pipe 42 has 6⅝" O. D. tool joint 44 attached at its upper end by suitable means as cold forging or welding. Elevator shoulder 46 of tool joint 44 functions as before. The problem with such a design is that prior art ram bore profile 34 is sized for the 6⅝" O. D. drill pipe 36 with 8" O. D. tool joint 38. When 6⅝" O. D. tool joint 44 is supported on prior art ram bore profile 34 only a very thin shoulder is present to support the weight of drill pipe 42 as seen in FIG. 5. The present invention solves this problem by providing a new and unique ram bore profile that accommodates different diameter tool joints and provides greatly increased load capacity.

Figure 6:
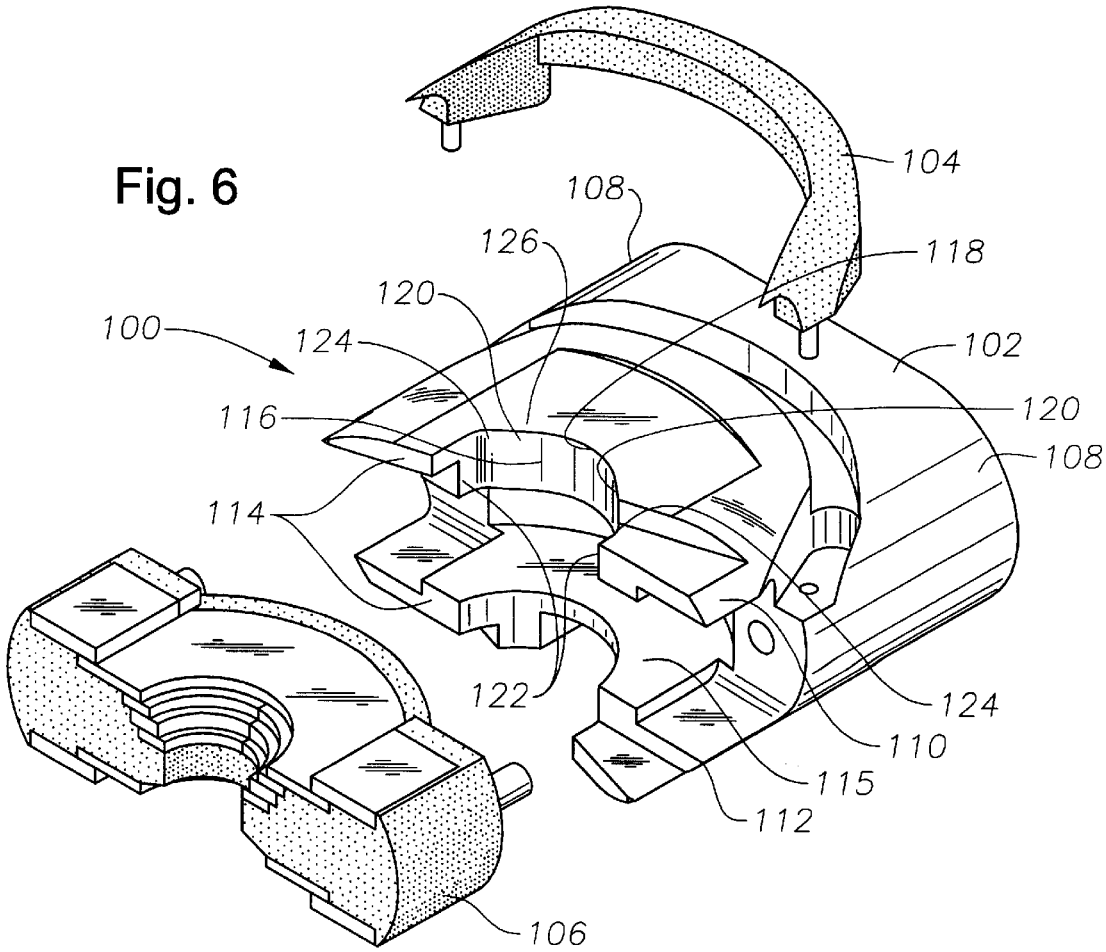
FIG. 6 is an exploded perspective view of one type of variable bore ram packer assembly utilizing the improved ram bore profile of the present invention.

With reference to FIG. 6, variable bore ram packer assembly 100 includes ram body 102, top seal 104 and variable bore packer 106. Ram body 102 is a generally rectangular parallelepiped shape with rounded sides 108 that fit in laterally disposed ram guideways 16. Ram body 102 includes upper body 110 and lower body 112 connected by front face 114 and defining ram packer cavity 115 therebetween. Formed within front face 114 of upper body 110 is ram bore profile 116. Ram bore profile 116 is substantially U shaped and extends vertically through upper body 110 to ram packer cavity 115. Ram bore profile 116 is further characterized by rear portion 118, diverging sides 120 and front throat 122. Rear portion 118 is an arcuate segment connected to front throat 122 by diverging sides 120. Front throat 122 intersects front face 114 at a substantially perpendicular angle. Arcuate sections 124 connect diverging sides 120. Area 126 adjacent ram bore profile 116 is hardened by suitable means as weld inlay or thermal treatment to increase the load carrying capacity of ram bore profile 116.

Figure 7:
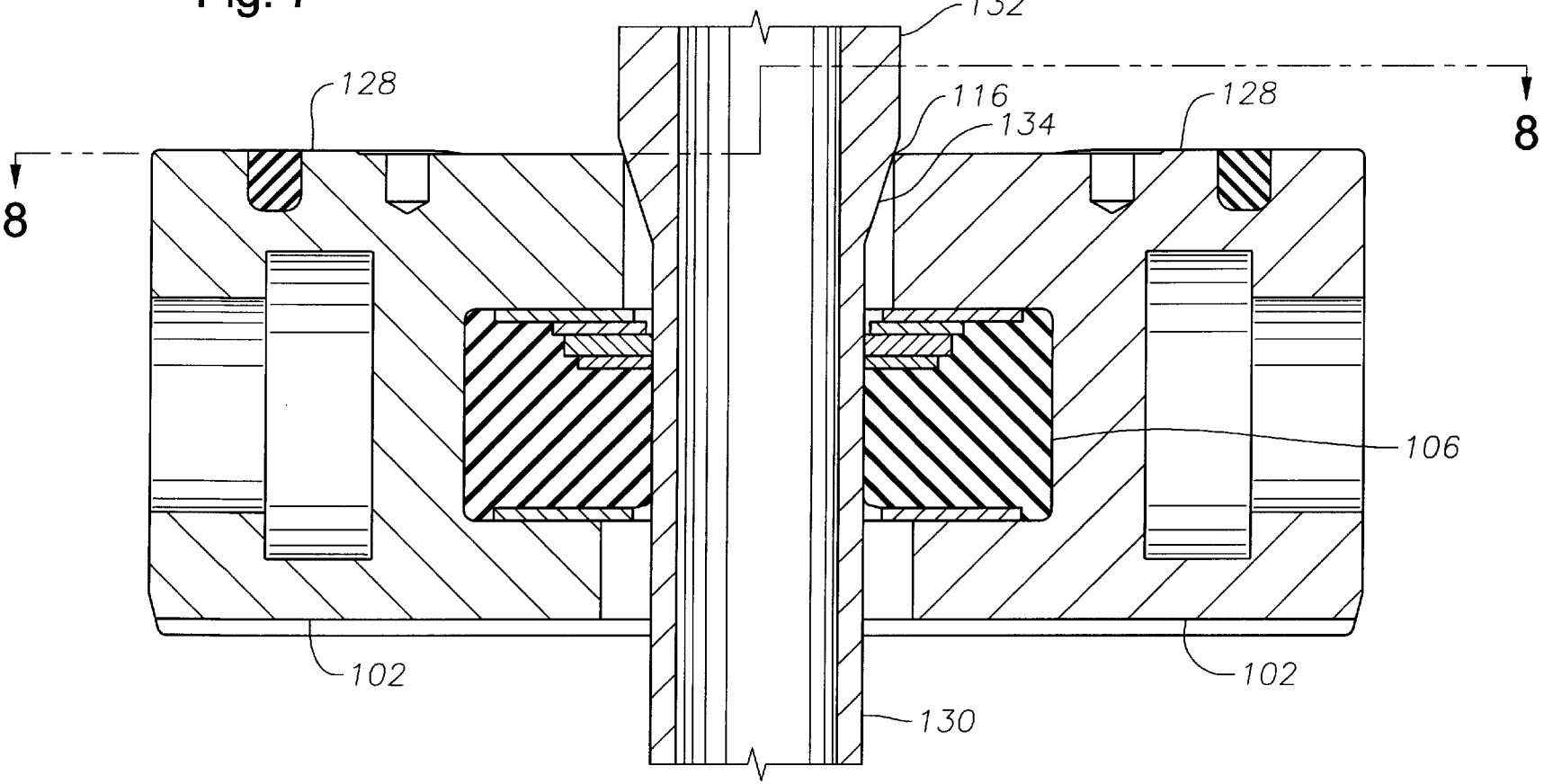
FIG. 7 is an elevation View in section of a pair of variable bore ram packers ysuspending 6⅝" drill pipe utilizing the improved ram bore profile of the present invention.
Figure 8:
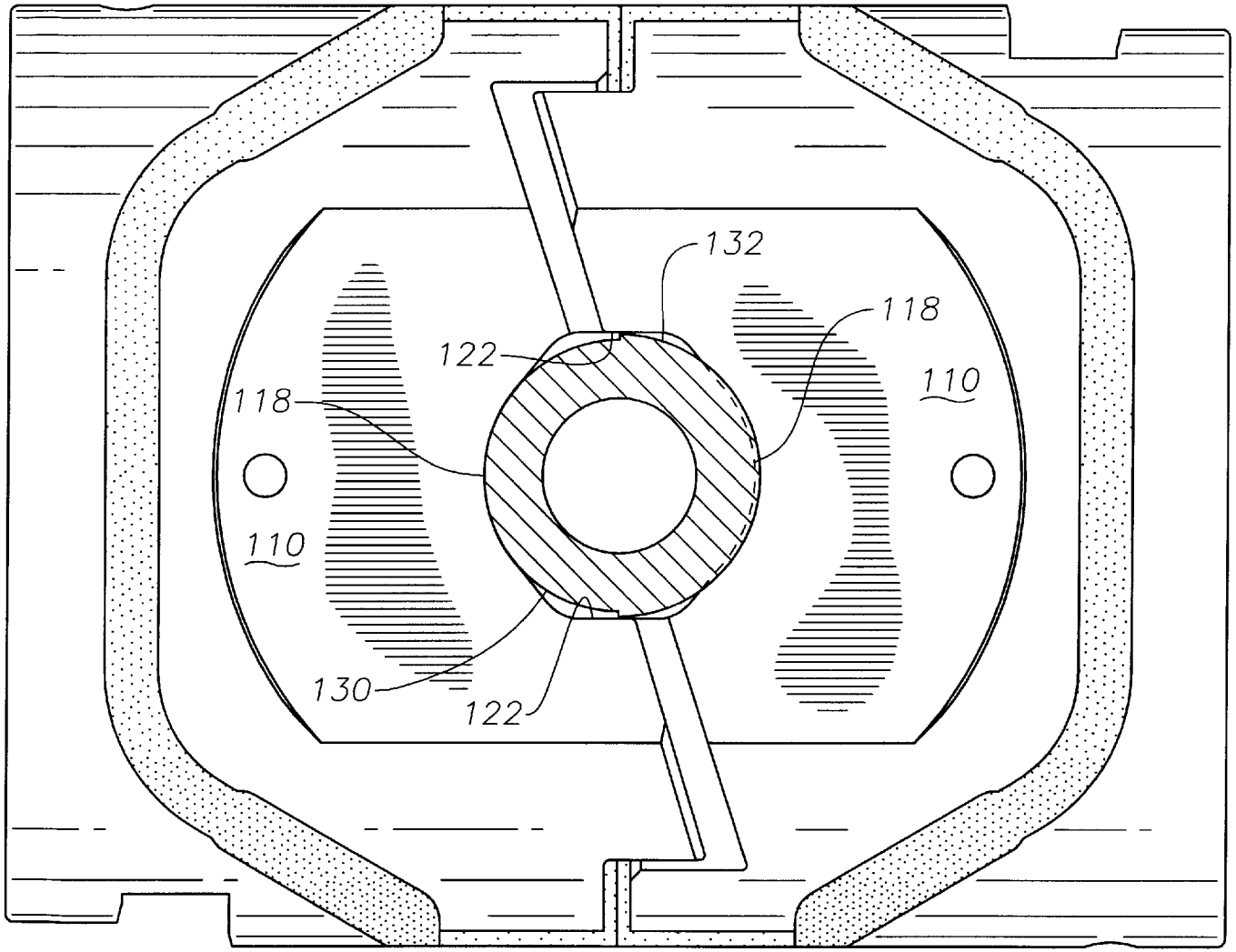
FIG. 8 is a plan view taken along lines 8—8 of FIG. 7.
Figure 9:
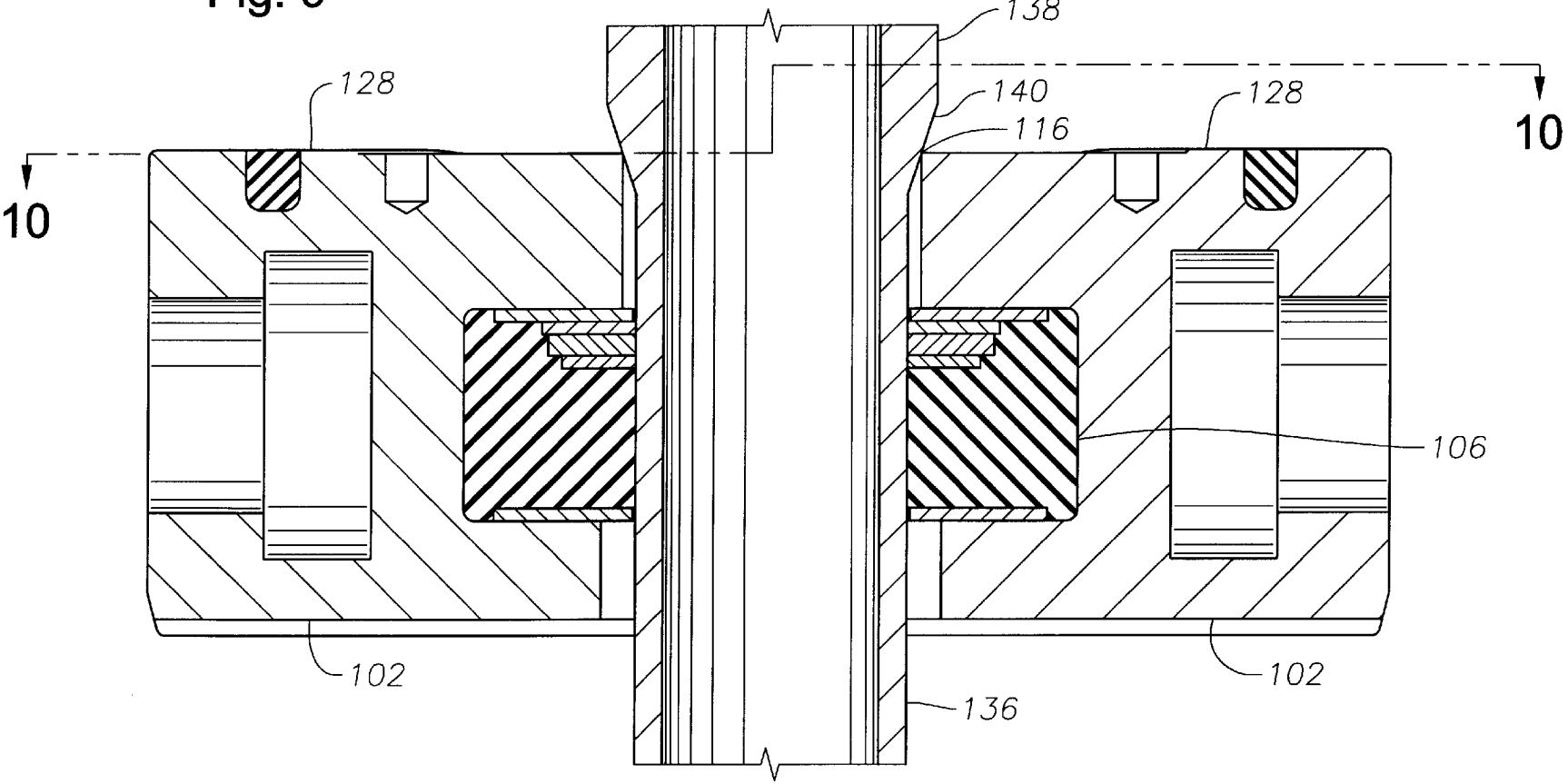
FIG. 9 is an elevation view in section of a pair of variable bore ram packers suspending 5" drill pipe utilizing the improved ram bore profile of the present invention.
Figure 10:
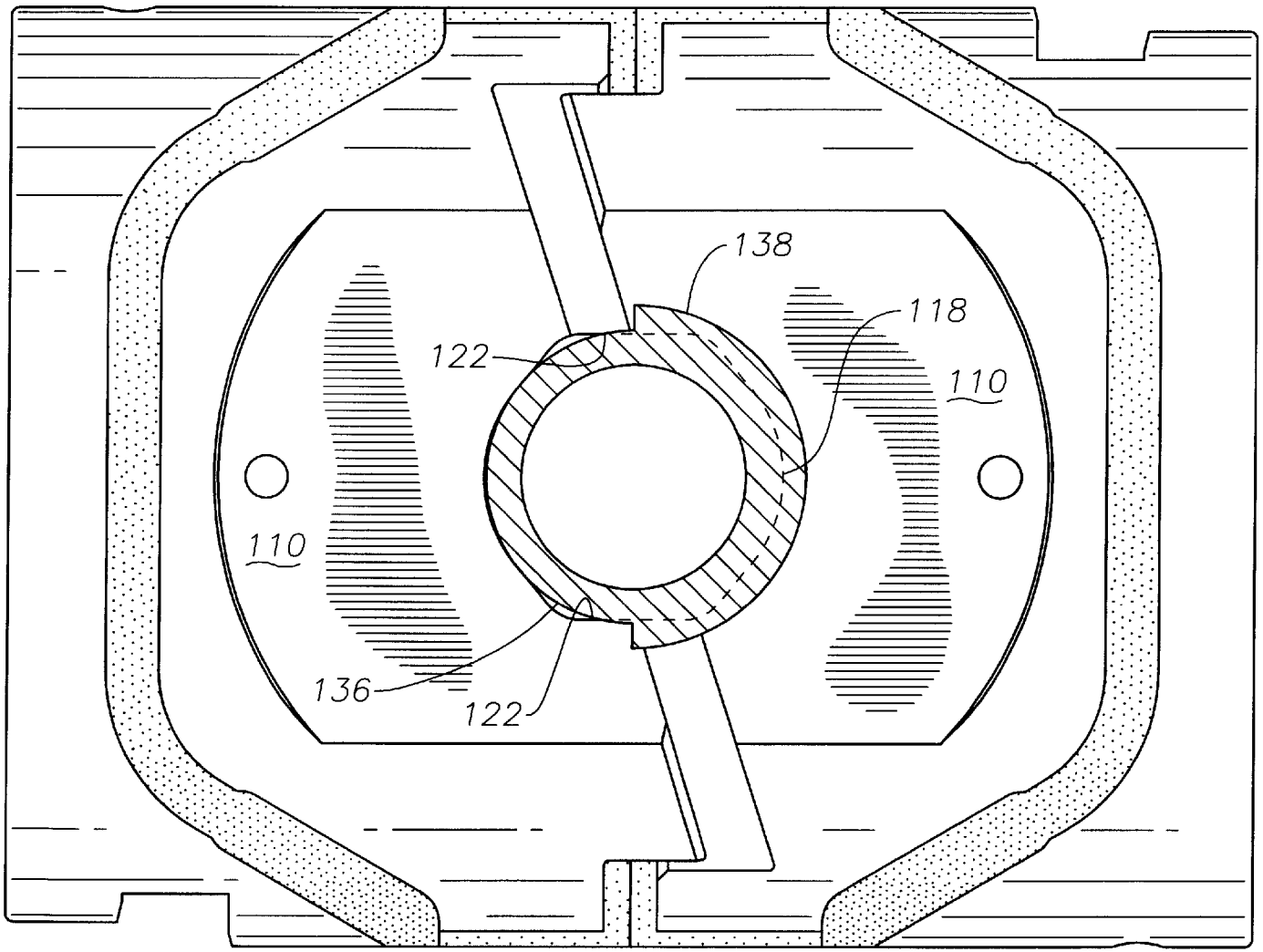
FIG. 10 is a plan view taken along lines 10—10 of FIG. 9.

As best seen in FIGS. 7–10, the unique ability of ram bore profile 116 to support different diameter tapered tubular members such as tool joints is shown. FIGS. 7 and 8 show a pair of rams 128 with variable bore ram packer 106 positioned within ram bodies 102. Positioned within rams 128 is 5" O. D. drill pipe 130 with tool joint 132 attached at its upper end and elevator shoulder 134 connecting therebetween. Tool joint 132 will typically have an 6⅝" O. D., as previously described. Improved ram bore profile 116 allows rear portion 118 to closely fit about drill pipe 130 while supporting tool joint 132 on elevator shoulder 134 to provide increased support. Similarly, FIGS. 9 and 10 show a pair of rams 128 with variable bore ram packer 106 positioned within ram bodies 102. Positioned within rams 128 is 6⅝" O. D. drill pipe 136 with tool joint 138 attached at its upper end and elevator shoulder 140 connecting therebetween. Tool joint 138 will typically have an 8" O. D., as previously described. Improved ram bore profile 116 allows rear portion 118 to closely fit about drill pipe 136 while supporting tool joint 138 on elevator shoulder 140 to provide increased support, particularly in the area of front throat 122. This provides increases support to drill pipe 136. Thus it is seen ram bore profile 116 accommodates a range of drill pipe sizes and their associated tool joints to allow increase load supporting capabilities and preventing damage the variable bore packer within.

Figure 11:
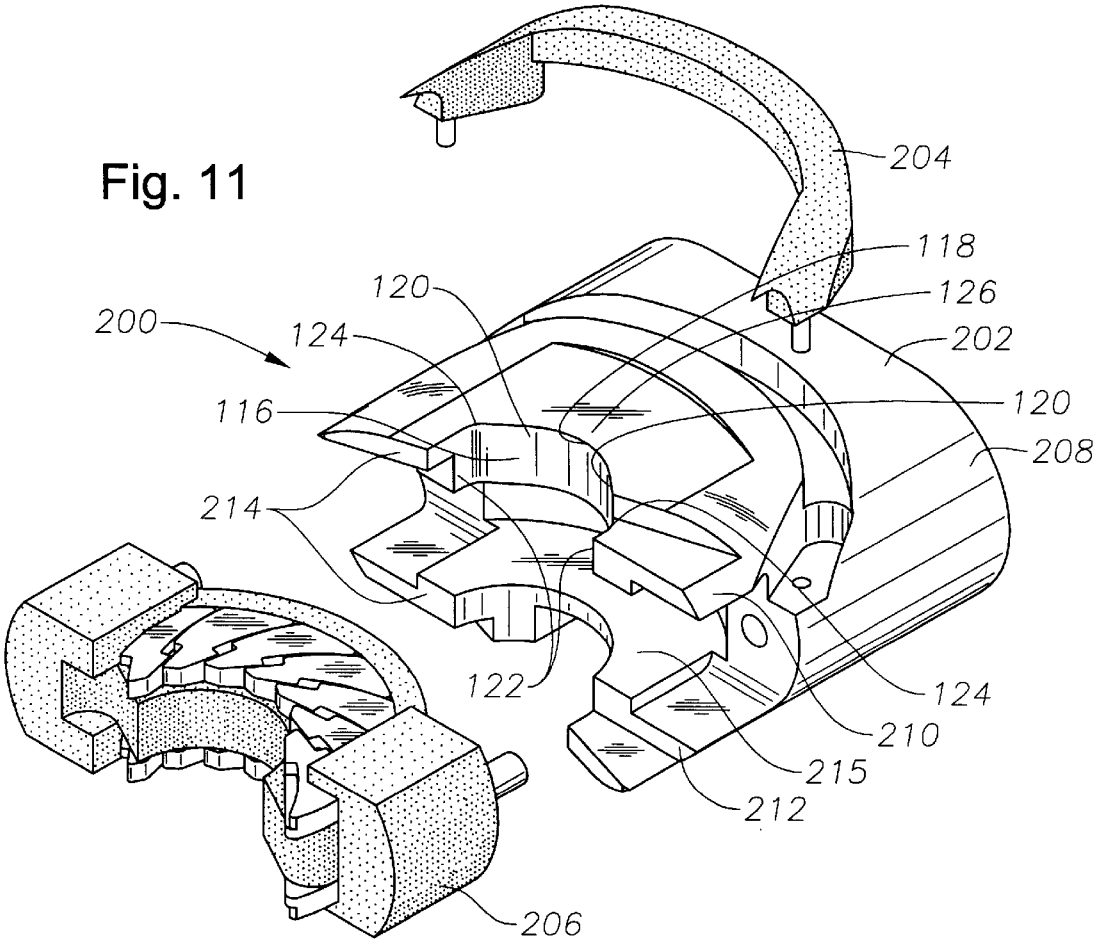
FIG. 11 is an exploded perspective view of a second type of variable bore ram packer assembly utilizing the improved ram bore profile of the present invention.

FIG. 11 shows the unique ram bore profile of the present invention in another type of variable bore ram packer assembly. This variable bore ram packer assembly 200 is of the type shown and claimed in pending U.S. application Ser. No. 09/550,403 filed Apr. 14, 2000 and is incorporated herein by reference. Those items which are the same as in the first embodiment retain the same numerical designations. Variable bore ram packer assembly 200 includes ram body 202, top seal 204 and variable bore packer 206. Ram body 202 is a generally rectangular parallelepiped shape with rounded sides 208 that fit in laterally disposed ram guideways 16. Ram body 202 includes upper body 210 and lower body 212 connected by front face 214 and defining ram packer cavity 215 therebetween. Formed within front face 214 is ram bore profile 116 as in the previous embodiment. Ram bore profile 116 is substantially U shaped and extends vertically through upper body 210 to ram packer cavity 215. Ram bore profile 116 is further characterized by rear portion 118, diverging sides 120 and front throat 122. Rear portion 118 is an arcuate segment connected to front throat 122 by diverging sides 120. Front throat 122 intersects front face 114 at a substantially perpendicular angle. Arcuate sections 124 connect diverging sides 120. Area 126 adjacent ram bore profile 116 is hardened by suitable means as weld inlay or thermal treatment to increase the load carrying capacity of ram bore profile 116.

Figure 12:
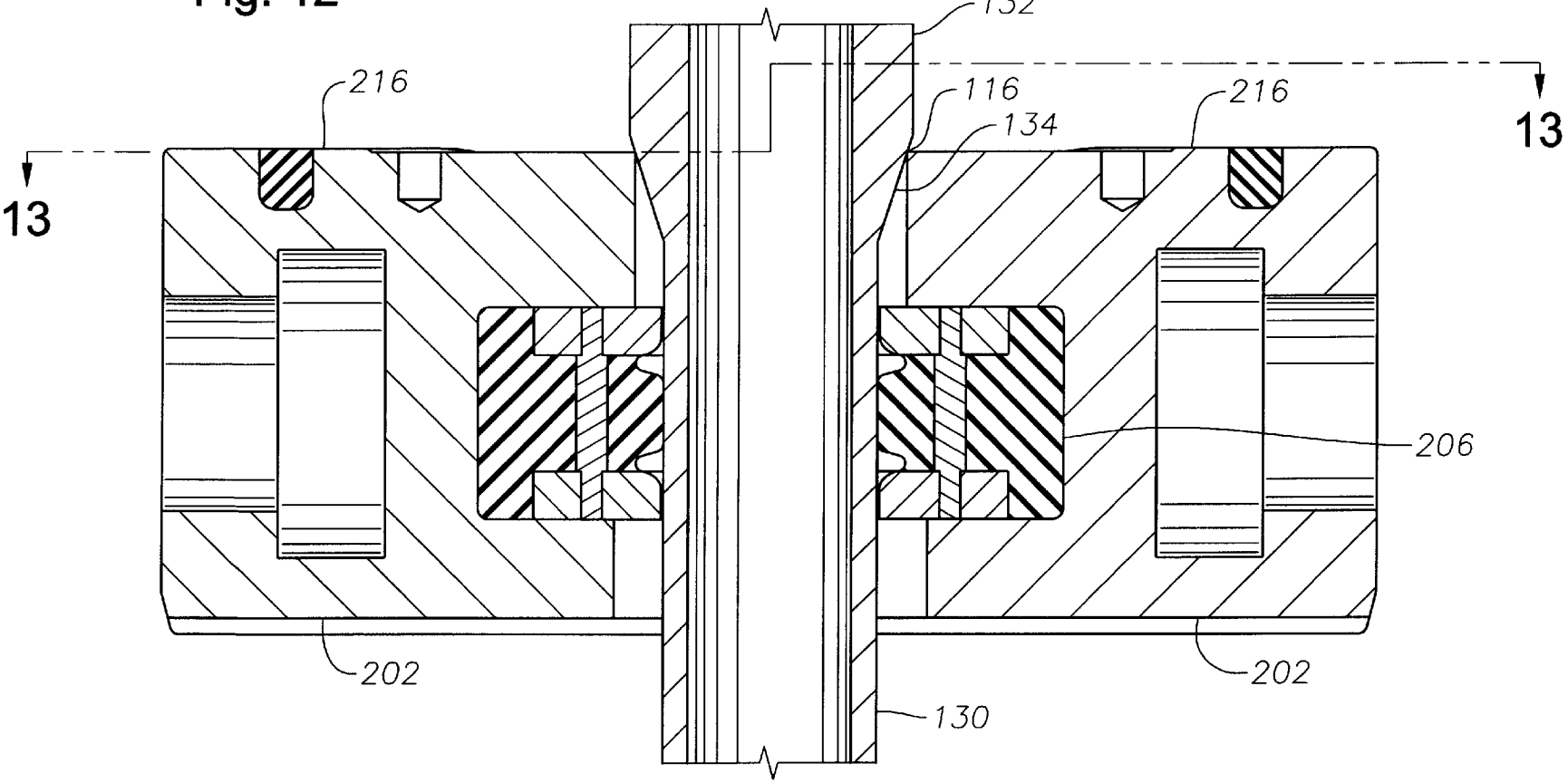
FIG. 12 is an elevation view in section of a pair of variable bore ram packers of the type shown in FIG. 11 suspending 5" drill pipe utilizing the improved ram bore profile of the present invention.
Figure 13:
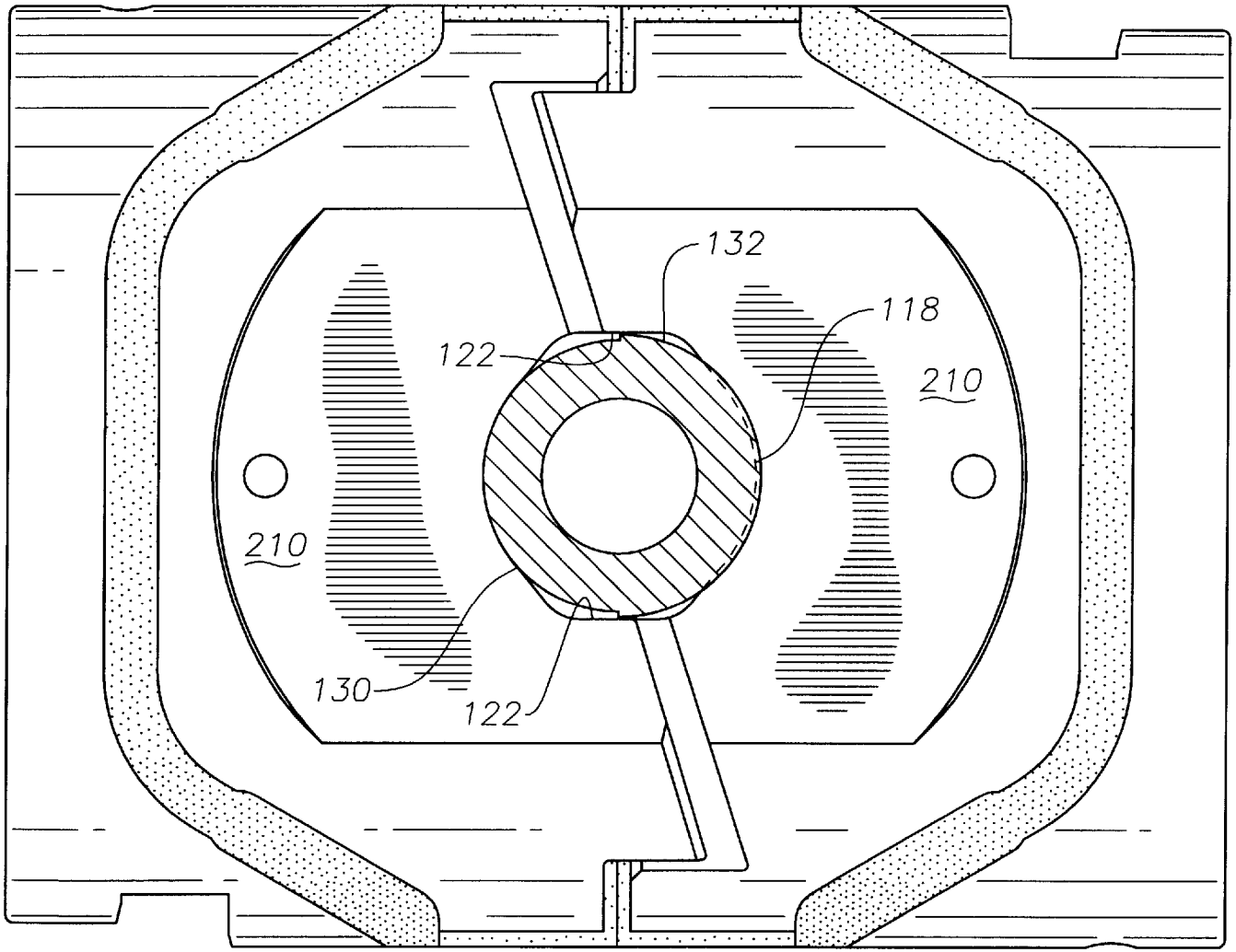
FIG. 13 is a plan view taken along lines 13—13 of FIG. 12.
Figure 14:
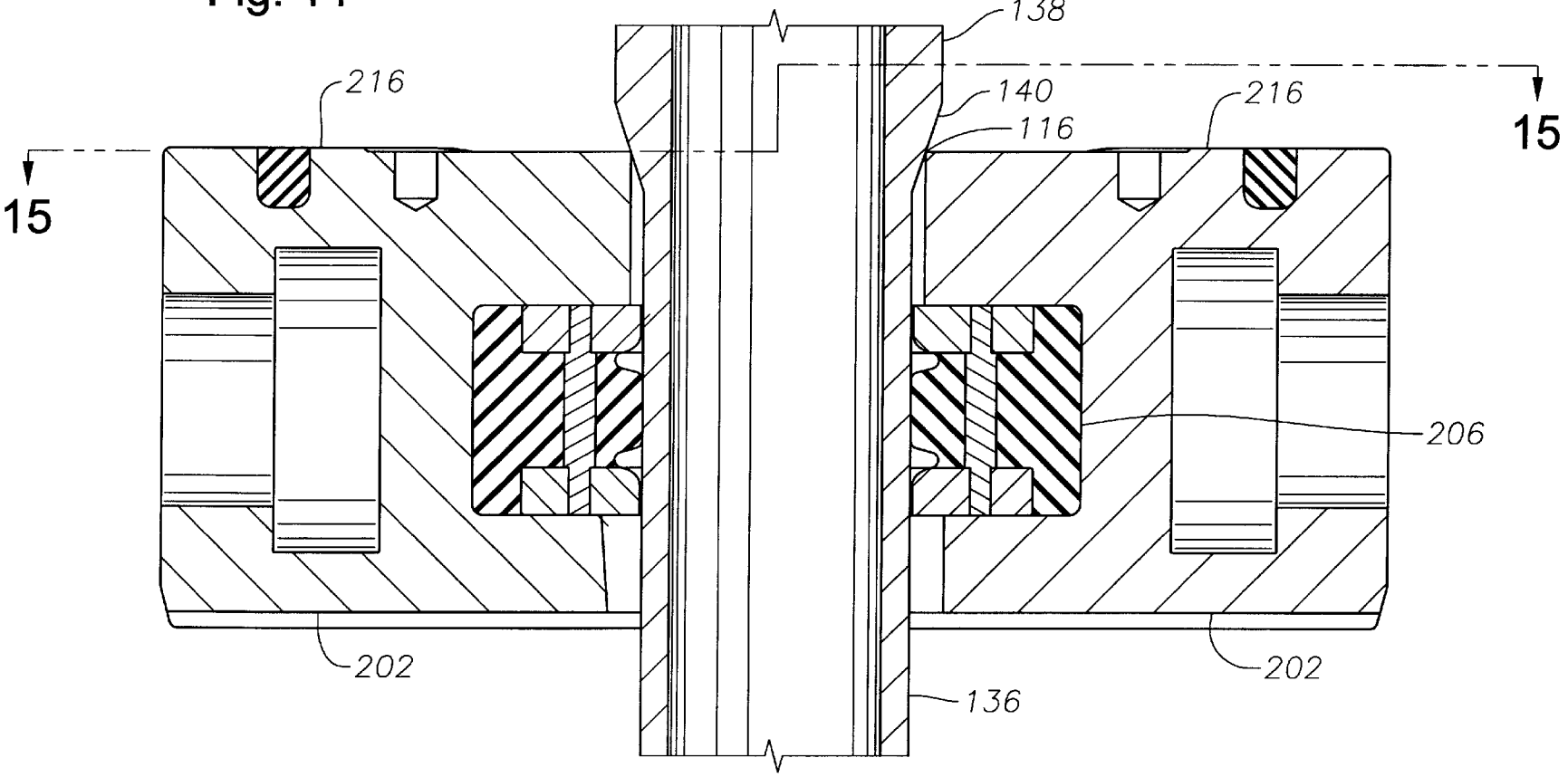
FIG. 14 is an elevation view in section of a pair of variable bore ram packers of the type shown in FIG. 11 suspending 6⅝" drill pipe utilizing the improved ram bore profile of the present invention.
Figure 15:
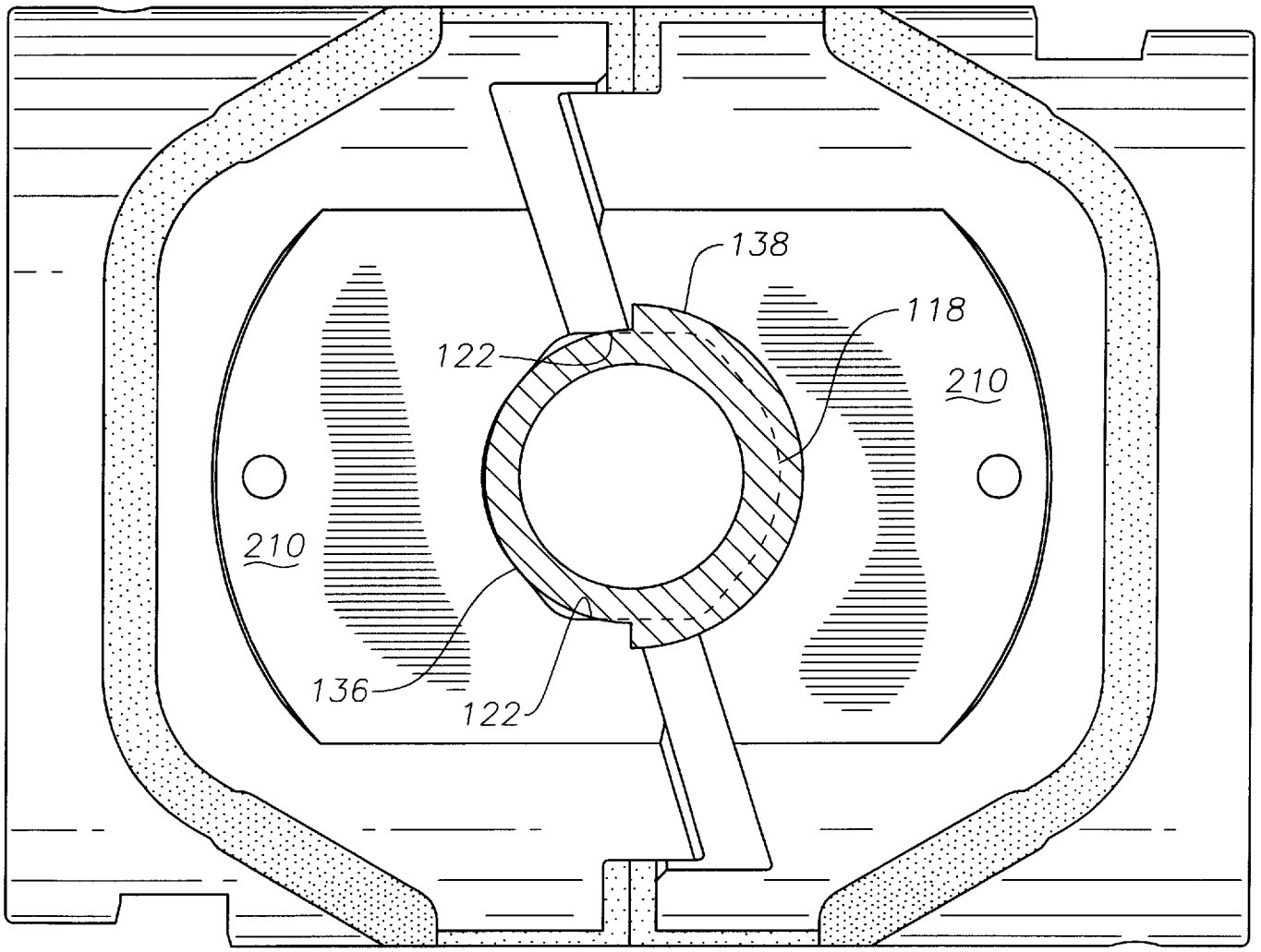
FIG. 15 is a plan view taken along lines 15—15 of FIG. 14.

As best seen in FIGS. 12–15, the unique ability of ram bore profile 116 to support different diameter tapered tubular members such as tool joints is again shown with the alternate variable bore packer 206. As before, FIGS. 12 and 13 show a pair of rams 216 with variable bore ram packer 206 positioned within ram bodies 202. Positioned within rams 216 is 5" O. D. drill pipe 130 with tool joint 132 attached at its upper end and elevator shoulder 134 connecting therebetween. Tool joint 132 will typically have an 6⅝" O. D., as previously described. Improved ram bore profile 116 allows rear portion 118 to closely fit about drill pipe 130 while supporting tool joint 132 on elevator shoulder 134 to provide increased support. Similarly, FIGS. 14 and 15 show a pair of rams 216 with variable bore ram packer 206 positioned within ram bodies 202. Positioned within rams 216 is 6⅝" O. D. drill pipe 136 with tool joint 138 attached at its upper end and elevator shoulder 140 connecting therebetween. Tool joint 138 will typically have an 8" O. D., as previously described. Improved ram bore profile 118 allows rear portion 118 to closely fit about drill pipe 136 while supporting tool joint 138 on elevator shoulder 140 to provide increased support, particularly in the area of front throat 122. This provides increases support to drill pipe 136. Thus it is seen ram bore profile 116 accommodates a range of drill pipe sizes and their associated tool joints to allow increase load supporting capabilities and will work with different types of variable bore packer designs.

The construction of my improved ram bore profile for a variable bore packer ram in a ram type blowout preventer variable bore ram packer will be readily understood from the foregoing description and it will be seen that I have provided an improved ram bore profile to accommodate a range of tubular member diameters. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims

What is claimed is:

1. A ram used in a ram blowout preventer for oil and gas drilling operations, comprising:

a ram body;

said ram body having a front face, said front face having a ram bore profile positioned therein;

said ram bore profile substantially U shaped to support a shouldered tubular member within a specified diameter range;

said ram body includes a lower body and an upper body, said lower body and said upper body define a ram packer cavity therebetween;

said substantially U shaped ram bore profile in said ram body includes a rear portion substantially formed as an arcuate segment, a pair of diverging sides extending from said rear portion of said ram bore profile toward said front face of said ram body at an oblique angle, and;

said pair of diverging sides of said ram bore profile connected by arcuate sections to a front throat of said ram bore profile, said front throat having parallel sides that are substantially perpendicular to said front face of said ram body.

2. A ram used in a ram blowout preventer for oil and gas drilling operations according to claim 1, wherein:

said upper ram body adjacent said ram bore profile is inlayed with a different material than said upper ram body.

3. A ram used in a ram blowout preventer for oil and gas drilling operations according to claim 1, wherein:

said upper ram body adjacent said ram bore profile is hardened.

4. A ram used in a ram blowout preventer for oil and gas drilling operations according to claim 3, wherein:

said ram body is for use with a variable bore packer.

5. A variable bore ram packer assembly used in a ram blowout preventer for oil and gas drilling operations, comprising:

a ram body;

said ram body having a front face, said front face having a ram bore profile positioned therein;

said ram bore profile substantially U shaped to support a shouldered tubular member within a specified diameter range;

a plurality of side packers and a top seal positioned on said ram body to seal said ram body within a ram blowout preventer;

said ram body includes a lower body and an upper body, said lower body and said upper body define a ram packer cavity therebetween;

said substantially U shaped ram bore profile in said ram body includes a rear portion substantially formed as an arcuate segment, a pair of diverging sides extending from said rear portion of said ram bore profile toward said front face of said ram body at an oblique angle, and;

said pair of diverging sides of said ram bore profile connected by arcuate sections to a front throat of said ram bore profile, said front throat having parallel sides that are substantially perpendicular to said front face of said ram body.

6. A variable bore ram packer assembly used in a ram blowout preventer for oil and gas drilling operations according to claim 5, wherein:

said upper ram body adjacent said ram bore profile is hardened.

7. A variable bore ram packer assembly used in a ram blowout preventer for oil and gas drilling operations according to claim 5, wherein:

said upper ram body adjacent said ram bore profile is inlayed with a different material than said upper ram body.

8. A ram blowout preventer for oil and gas drilling operations including a pair of variable bore rams, comprising:

a body with a vertical bore;

a pair of opposing bonnet assemblies laterally disposed in said body;

a pair of opposing variable bore rams laterally moveable within said bonnet assemblies;

each of said opposing variable bore rams including a ram body;

each of said ram bodies having a front face, said front face having a ram bore profile positioned therein;

said ram bore profile substantially U shaped to support a shouldered tubular member within a specified diameter range;

a plurality of side packers and a top seal positioned on each of said ram bodies to seal said ram body within said ram blowout preventer;

said ram body includes a lower body and an upper body, said lower body and said upper body define a ram packer cavity therebetween;

said substantially U shaped ram bore profile in said ram body includes a rear portion substantially formed as an arcuate segment, a pair of diverging sides extending from said rear portion of said ram bore profile toward said front face of said ram body at an oblique angle, and;

said pair of diverging sides of said ram bore profile connected by arcuate sections to a front throat of said ram bore profile, said front throat having parallel sides that are substantially perpendicular to said front face of said ram body.

9. A ram blowout preventer for oil and gas drilling operations including a pair of variable bore rams according to claim 8, wherein:

said upper ram body adjacent said ram bore profile is hardened.

10. A ram blowout preventer for oil and gas drilling operations including a pair of variable bore rams according to claim 8, wherein:

said upper ram body adjacent said ram bore profile is inlayed with a different material than said upper ram body.

* * * * *